US007534373B2

(12) United States Patent
Cho et al.

(10) Patent No.: US 7,534,373 B2
(45) Date of Patent: May 19, 2009

(54) COMPOSITION FOR FORMING ELECTRON EMISSION SOURCE, METHOD FOR PREPARING ELECTRON EMISSION SOURCE USING THE SAME, AND ELECTRON EMISSION SOURCE PREPARED THEREFROM

(75) Inventors: Sung-Hee Cho, Suwon-si (KR); Jong-Woon Moon, Suwon-si (KR); Hyun-Jung Lee, Suwon-si (KR); Jong-Hwan Park, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 519 days.

(21) Appl. No.: 11/213,893

(22) Filed: Aug. 30, 2005

(65) Prior Publication Data

US 2006/0043864 A1 Mar. 2, 2006

(30) Foreign Application Priority Data

Aug. 30, 2004 (KR) ..... 10-2004-0068601

(51) Int. Cl.
*H01B 1/24* (2006.01)
*H01J 1/00* (2006.01)

(52) U.S. Cl. ..... 252/511; 977/783; 313/311

(58) Field of Classification Search ..... 252/511; 977/783; 313/311
See application file for complete search history.

(56) References Cited

U.S. PATENT DOCUMENTS

| | | | | |
|---|---|---|---|---|
| 6,436,221 | B1 | 8/2002 | Chang et al. | |
| 6,645,402 | B1 * | 11/2003 | Kurokawa et al. | 252/502 |
| 6,653,366 | B1 * | 11/2003 | Imai et al. | 523/160 |
| 6,734,262 | B2 * | 5/2004 | Patel | 525/419 |
| 7,115,432 | B2 * | 10/2006 | Kagami et al. | 438/30 |
| 7,303,854 | B2 * | 12/2007 | Hayakawa | 430/270.1 |
| 7,365,482 | B2 * | 4/2008 | Ryu et al. | 313/495 |
| 2004/0263044 | A1 * | 12/2004 | Yoon et al. | 313/311 |
| 2005/0179355 | A1 * | 8/2005 | Yoo et al. | 313/311 |

* cited by examiner

*Primary Examiner*—Douglas Mc Ginty
(74) *Attorney, Agent, or Firm*—H.C. Park & Associates, PLC

(57) ABSTRACT

The present invention provides a composition for forming an electron emission source comprising a carbon-based material and a vehicle comprising a resin component and a solvent component. The resin component is a material that has less than 0.5 wt % of carbon deposits after undergoing a heat treatment at 450° C. under nitrogen atmosphere. The present invention also provides a method of preparing an electron emission source using the composition for forming an electron emission source, and an electron emission source that is prepared using the electron emission source. The electron emission source prepared using the composition has a small amount of the carbon deposits which improves its electric current density and lengthens its lifespan.

7 Claims, 10 Drawing Sheets

COMPOSITION FOR FORMING ELECTRON EMISSION SOURCE, METHOD FOR PREPARING ELECTRON EMISSION SOURCE USING THE SAME, AND ELECTRON EMISSION SOURCE PREPARED THEREFROM

CROSS REFERENCE TO RELATED APPLICATION

This application claims priority to and the benefit of Korean Patent Application No. 10-2004-0068601, filed on Aug. 30, 2004 in the Korean Intellectual Property Office, the disclosure of which is incorporated herein in its entirety by reference.

BACKGROUND OF THE INVENTION

1. Field of the Invention

The present invention relates to a composition for forming an electron emission source, a method for preparing an electron emission source, and an electron emission source prepared therefrom. In particular, the present invention relates to a composition for forming an electron emission source that has decreased carbon deposits after heat treatment, a method of preparing such an electron emission source, and an electron emission source that has a very small amount of the carbon deposits. The present invention also relates to an electron emission device that includes the electron emission source.

2. Description of the Related Art

An electron emission device is a display apparatus that applies a voltage between an anode and a cathode to form an electric field, which causes electrons to be emitted from an electron emission source of the cathode. The device then bombards electrons into a fluorescent material at the anode to emit light.

A carbon-based material such as a carbon nanotube (CNT) is a promising electron emission source for an electron emission device because it has excellent conductivity and electric field focusing effect. In addition, the driving voltage of the carbon nanotubes is low due to its low work function and excellent field emission properties, and thus, it can be applied in large area. An electron emission source employing a carbon-based material is described in U.S. Pat. No. 6,436,221, for example.

An electron emission source comprising a carbon-based material, such as a carbon nanotube, can be prepared by a deposition method or a paste method. These methods use a composition for forming an electron emission source comprising carbon nanotube powder.

In the paste method, the concentration of the carbon deposits that are present after heat treatment of the composition is excessively high compared to the concentration of the carbon-based material that comprises the resulting electron emission source. Thus, the carbon deposits may cover the carbon-based material or interfere with the vertical orientation of the carbon-based material. For this reason, a satisfactory field emission device with a long lifespan may not be obtained.

SUMMARY OF THE INVENTION

This invention provides an electron emission source that is prepared using a composition for forming an electron emission source that comprises a very small amount of carbon deposits. Accordingly, high electric current density, long lifespan, and improved reliability can be obtained.

Additional features of the invention will be set forth in the description which follows, and in part will be apparent from the description, or may be learned by practice of the invention.

The invention discloses a composition for forming an electron emission source comprising a carbon-based material and a vehicle. The vehicle comprises a resin and a solvent, wherein the resin has less than 0.5 wt % of carbon deposits when the composition is heat treated at 450° C. under a nitrogen atmosphere.

The present invention also discloses a method for preparing an electron emission source comprising providing the composition for forming an electron emission source, printing the composition on a substrate, and heat-treating the printed composition.

The present invention also discloses an electron emission source comprising a carbon-based material and carbon deposits. The concentration amount of the carbon deposit is about 20 wt % to 30 wt % based on the weight of the carbon-based material.

The present invention also discloses an electron emission device comprising a first substrate and a second substrate that are positioned opposite each other with a cathode formed on the first substrate. The device further comprises an electron emission source that is coupled to the cathode that comprises a carbon-based material and carbon deposits. The concentration of the carbon deposits is 20 wt % to 30 wt % based on the weight of the carbon-based material. In addition, the device comprises an anode that is formed on the second substrate and a fluorescent layer that is formed on any side of the anode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

A composition for forming an electron emission source according to the present invention comprises a carbon-based material and a vehicle comprising a resin component and a solvent component. The resin component is a material that has less than 0.5 wt % of carbon deposits after heat treatment at 450° C. in a nitrogen atmosphere. The resin component may have less than 0.2 wt % of carbon deposits.

The term "carbon deposit" refers herein to a solid residue that remains after heat treating an organic compound. The constituents of the carbon deposits vary depending on the content of an organic compound that is heat treated. Particularly, it is to be understood that the carbon deposits contained in an electron emission source means the solid residue that remains after heat treatment of a remaining organic compound except for carbon-based materials among the various constituents contained in a composition for forming an electron emission source.

The carbon-based material contained in the composition for forming an electron emission source has excellent conductivity and electron emission properties. Thus, it aids in emitting an electron to a fluorescent layer of an anode when operating an electron emission device, thereby exciting a fluorescent body. Such carbon-based materials may include, but are not limited to a carbon nanotube, a graphite, a diamond, a fullerene and SiC, etc. Among these, the carbon nanotube is preferable.

The vehicle included in the composition for forming an electron emission source aids in controlling printability and viscosity. The vehicle comprises a resin component and a solvent component. The resin component has less than 0.5 wt % of carbon deposits when heat treated at 450° C. in a nitrogen atmosphere. The resin component may also comprise less than 0.2 wt % of carbon deposits.

The term "quantity of carbon deposit" herein can be understood as representing the ratio of weights after heat treatment to weights before heat treatment of a specific material as weight percent. The heat treatment of the composition is typically performed at 450° C. under a nitrogen atmosphere. The temperature and atmosphere of the heat treatment was selected by considering the optimal heat treatment conditions of the components of the composition for forming an electron emission source. It is easily recognizable to those skilled in the art that similar results can be predicted at the temperature and atmosphere measuring the carbon deposits, and the equivalents thereof.

Figure 1:
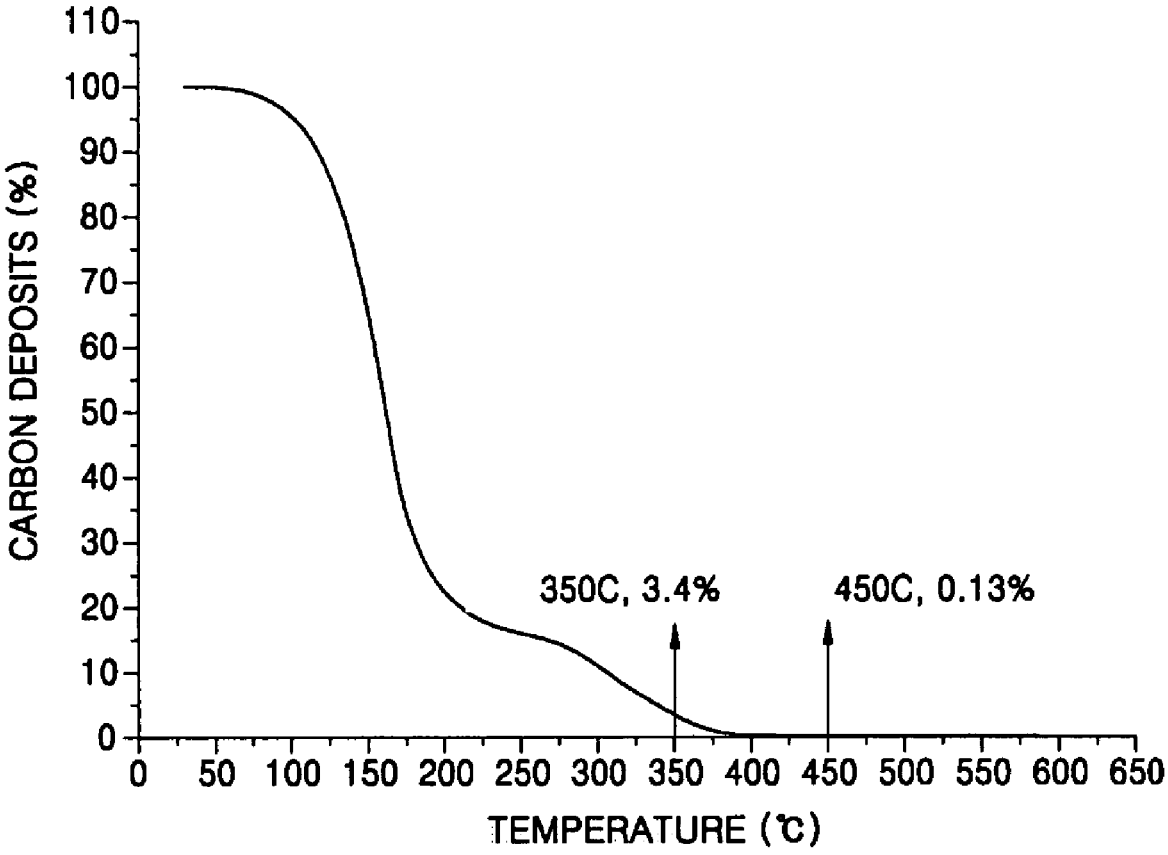
FIG. 1 and FIG. 2 are graphs illustrating the weight percents of the carbon deposits that were measured after heat treatment in a nitrogen atmosphere of a resin component contained in the composition for forming an electron emission source according to the present invention as a function of heat treatment temperature.

FIG. 1 is a graph illustrating the weight percent of carbon deposits that were measured after heat treatment of an acrylic resin in the form of a copolymer that includes methylacrylate and ethylacrylate at various temperatures under nitrogen atmosphere. It can be seen that the material has 0.13 wt % of carbon deposits at 450° C.

Figure 2:
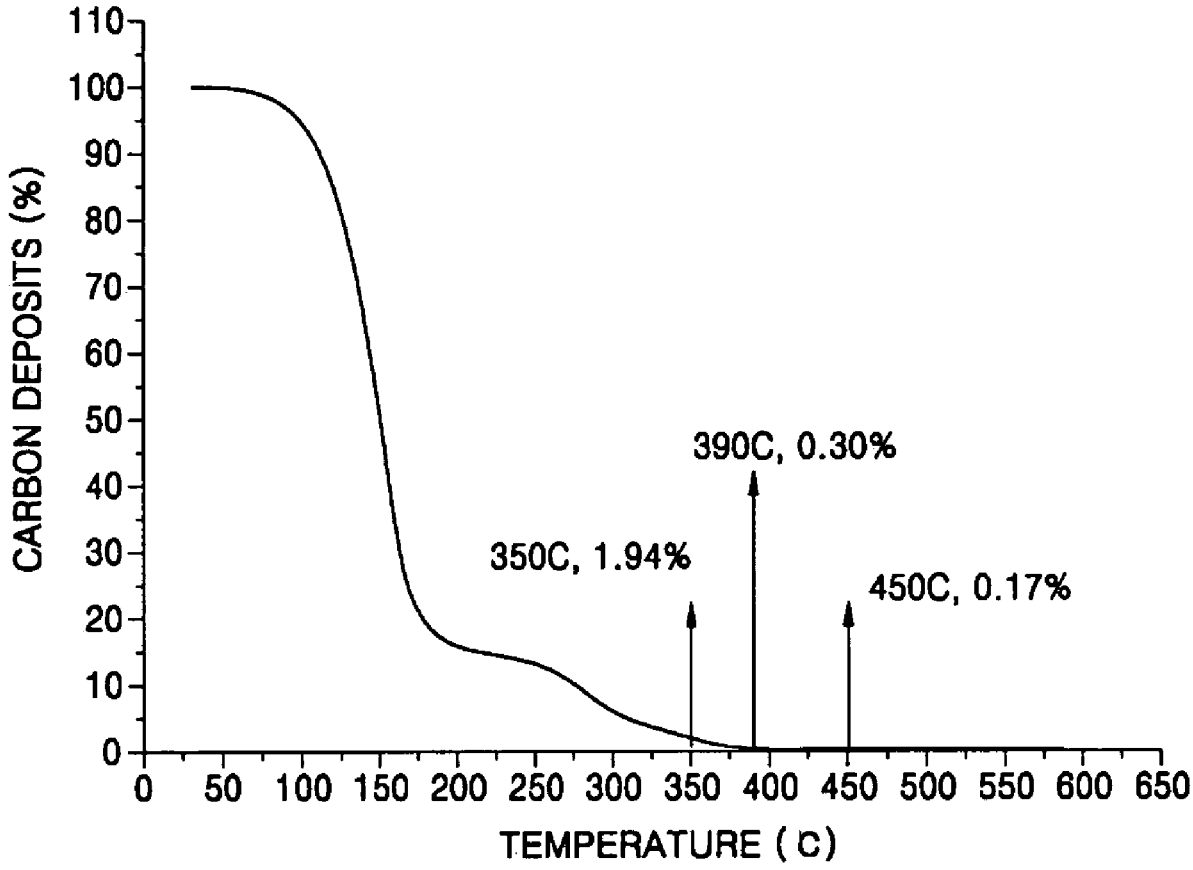

FIG. 2 is a graph illustrating the weight percent carbon deposits that were measured after heat treatment of an acrylic resin in the form of a copolymer that includes methylacrylate and butylacrylate at various temperatures under a nitrogen atmosphere. It can be seen that the material has 0.17 wt % of carbon deposits at 450° C.

The resin component may comprise acrylic resins. The acrylic resins may include resins that have at least one monomer including, but not limited to methylacrylate, ethylacrylate, propylacrylate, n-butylacrylate, isobutylacrylate, t-butylacrylate, 2-ethylhexylacrylate, laurylacrylate, methylmethacrylate, ethylmethacrylate, propylmethacrylate, n-butylmethacrylate, t-butylmethacrylate, 2-ethylhexylmethacrylate, laurylmethacrylate, cyclohexylacrylate, cyclohexylmethacrylate and cellosolvemethacrylate.

The solvent component in the vehicle according to the present invention may include but is not limited to terpineol, butyl carbitol (BC), butyl carbitol acetate (BCA), toluene and texanol, etc. Terpineol is preferably used as the solvent.

The concentration of the resin component can be about 60 wt % to 500 wt % and more preferably about 80 wt % to 300 wt %, based on the weight of the carbon-based material. The concentration of the solvent component can be about 300 wt % to 1500 wt % and preferably about 300 wt % to 1200 wt %, based on the weight of the carbon-based material. When the concentration of the components of the vehicle is out of these ranges, the printability of the composition for forming an electron emission source may decrease due to an increase in viscosity of the vehicle. Particularly, when the concentration of the components of the vehicle exceeds the range, the drying time can be excessively prolonged.

The composition for forming an electron emission source according to the present invention may further comprise a photosensitive resin and a photo-initiator. The photosensitive resin is used for patterning an electron emission source, and the photo-initiator initiates crosslinking of the photosensitive resin when the photosensitive resin is exposed to light.

Examples of the photo-initiator may include but are not limited to a benzophenone-based monomer such as a benzophenone, an acetophenone-based monomer, and a thioxanthone-based monomer.

The photosensitive resin and the photo-initiator combine to form an exposure product that subsequently undergoes heat treatment along with the carbon-based material and vehicle to form an electron emission source. The photosensitive resin of the present invention can be a material that an exposure product of the photosensitive resin and the photo-initiator has less than 7 wt % and preferably less than 6 wt % of carbon deposits when heat treated at 450° C. under a nitrogen atmosphere. The exposure condition may be, for example, ultraviolet irradiation at about 380 nm to 420 nm depending on the effect of ultraviolet radiation exposure on the composition for forming an electron emission source.

The photosensitive resin may include but is not limited to at least one of a carboxylated polyester acrylate oligomer, a carboxylated polyester acrylate oligomer comprising an epoxy acrylate, a polyester acrylate, a polyether diacrylate, a 2,4-diethyloxanthone, a 2,2-dimethoxy-2-phenylacetophenone, a hydroxyethylmethacrylate. The polyether diacrylate is preferably used as the photosensitive resin.

Figure 3:
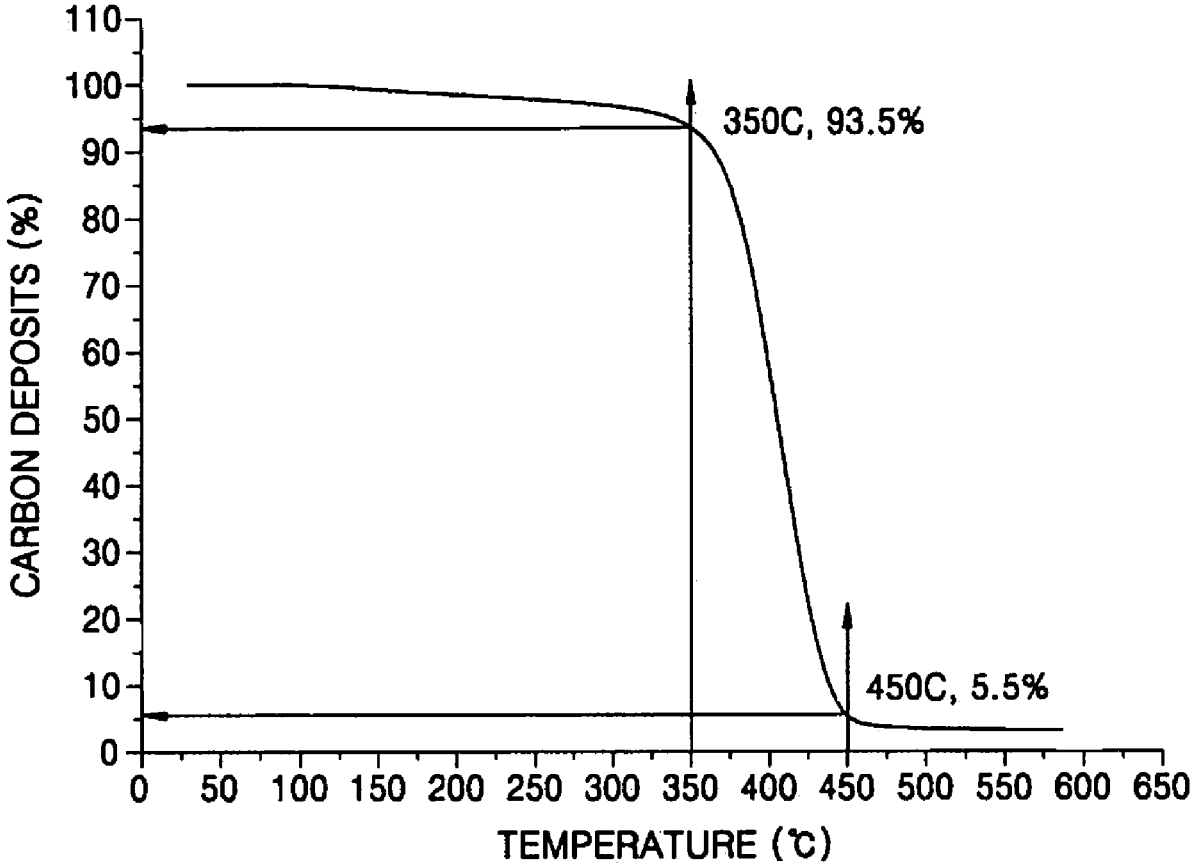
FIG. 3, FIG. 4 and FIG. 5 are graphs illustrating the weight percents of the carbon deposits that were measured after heat treatment in a nitrogen atmosphere of the exposure product of a photosensitive resin in presence of a photo-initiator contained in the composition for forming an electron emission source according to the present invention as a function of heat treatment temperature.
Figure 4:
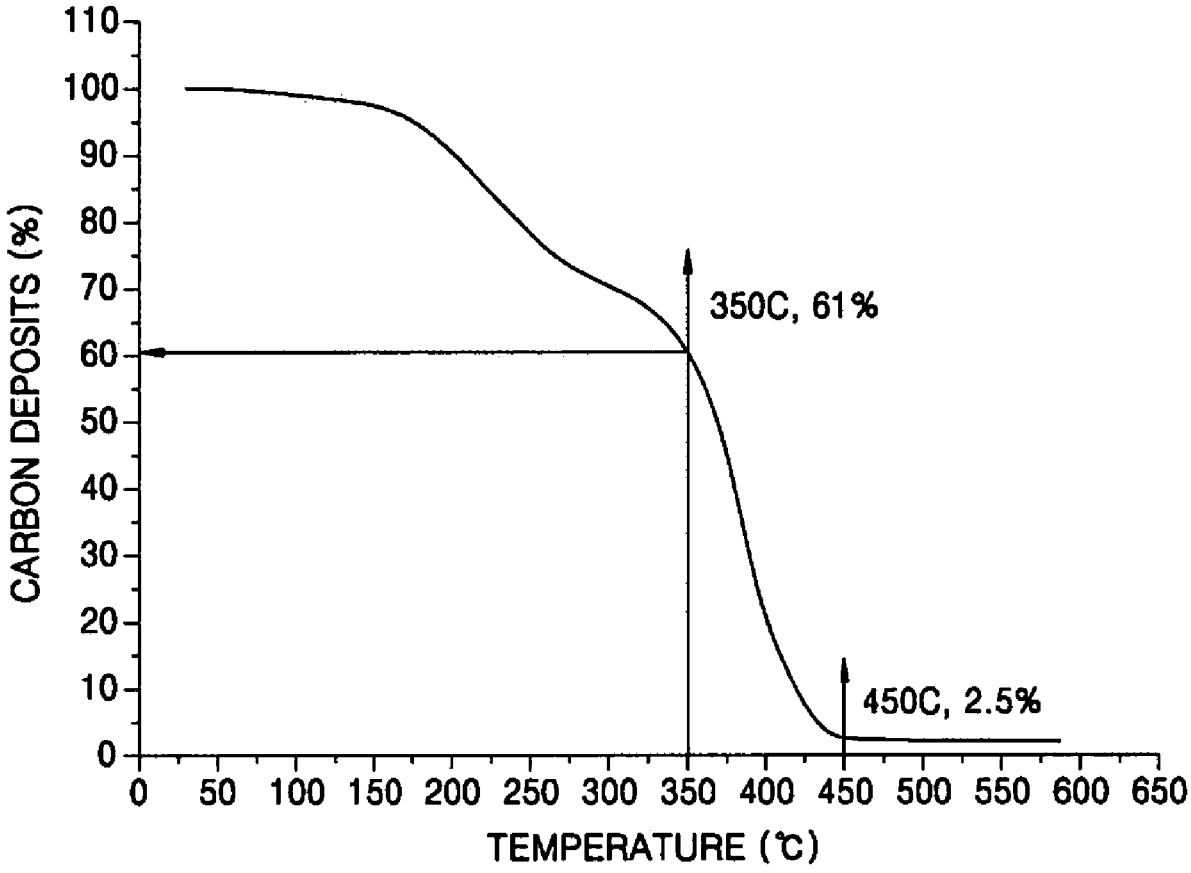
Figure 5:
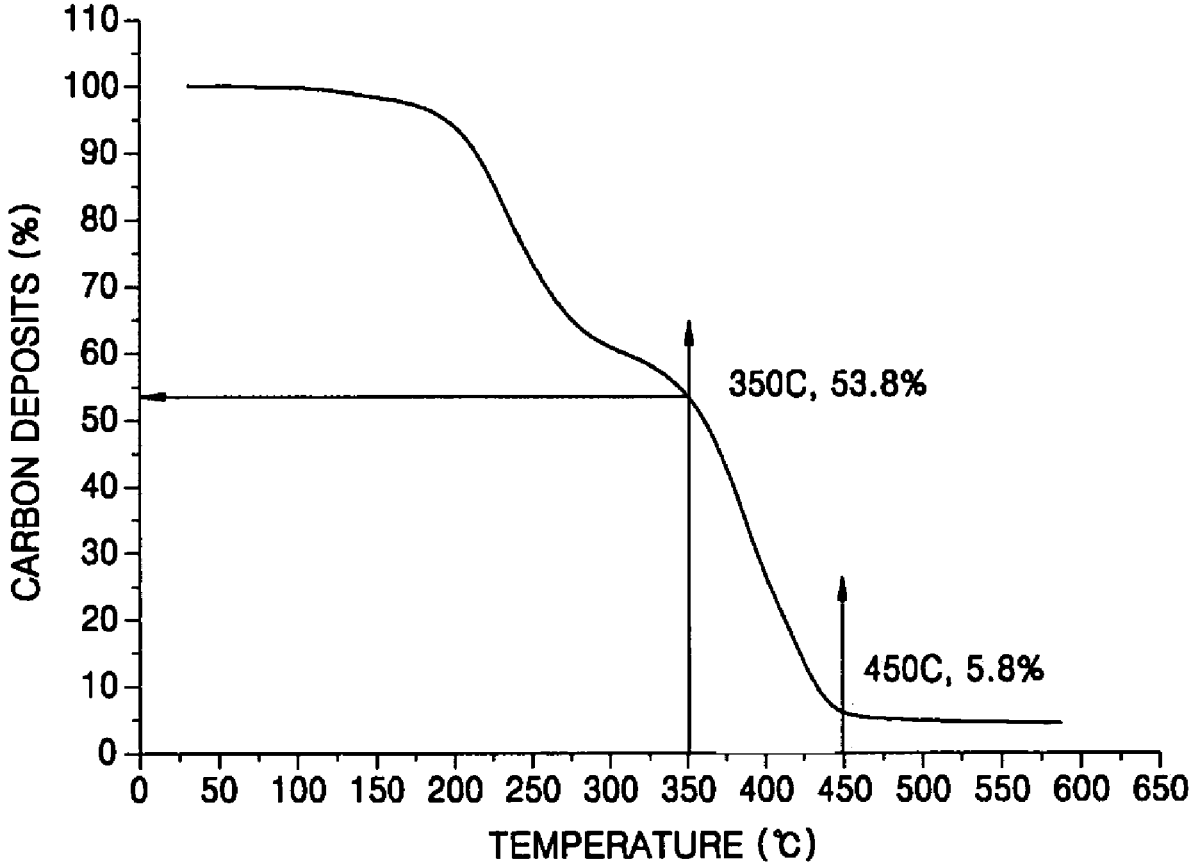

FIG. 3, FIG. 4, and FIG. 5 illustrate the concentration of the carbon deposits in the photosensitive resin of the composition for forming an electron emission source after heat treating the photosensitive resin at various temperatures in a nitrogen atmosphere.

FIG. 3 is a graph illustrating the concentration of the carbon deposits in the exposure product of a polyether diacrylate in the photosensitive resin and a benzophenone (HSP-188, from SK-UCB) as a photo-initiator treated at 400 nm after heat treatment at various temperatures in a nitrogen atmosphere. As shown in FIG. 3, the concentration of the carbon deposits of the exposure products of the polyether diacrylate at 450° C. is 5.5 wt %, which is suitable for use in forming the electron emission source of the present invention.

FIG. 4 is a graph illustrating the concentration of the carbon deposits in the exposure product of a carboxylated polyester acrylate comprising a hydroxyethylmethacrylate in the photosensitive resin, and a benzophenone (HSP-188, from SK-UCB) as a photo-initiator treated at 400 nm after heat treatment at various temperatures in a nitrogen atmosphere. As shown in FIG. 4, the concentration of the carbon deposits of the exposure products of the polyether diacrylate at 450° C. is 2.5 wt %, which is suitable for use in forming the electron emission source of the present invention.

FIG. 5 is a graph illustrating the concentration of the carbon deposits in the exposure product of a carboxylated polyester acrylate in the photosensitive resin, and a benzophenone (HSP-188 from SK-UCB) as a photo-initiator treated at 400 nm after being heat treated at various temperatures in a nitrogen atmosphere. As shown in FIG. 5, the concentration of the carbon deposits in the exposure products of the polyester diacrylate at 450° C. is 5.8 wt %, which is suitable for use in forming the electron emission source of the present invention.

The concentration of the photosensitive resin can be about 100 wt % to 1000 wt %, preferably 100 wt % to 800 wt % based on the weight of the carbon-based material. When the concentration of the photosensitive resin is less than 100 wt %, the exposure sensitivity may be decreased. When the concentration of the mixture exceeds 1000 wt %, the electron emission source will not be well developed.

The composition for forming an electron emission source may further comprise an adhesive component and a filler, etc. The adhesive component helps an electron emission source adhere to a substrate and may include an inorganic binder, etc. Such an inorganic binder may include, but is not limited to a glass frit, a silane, and a water glass. More than two binders may be used in mixture. The frit can be, for example, a lead oxide-zinc oxide-boron oxide ($PbO—ZnO—B_2O_3$) compound. The glass frit is preferably used as the inorganic binder.

The concentration of the inorganic binder in the composition for forming an electron emission source can be about 10 wt % to 50 wt %, preferably 15 wt % to 35 wt % based on the weight of the carbon-based material. When the concentration of the inorganic binder is less than 10 wt % based on the weight of the carbon-based material, the strength of the adhesion is insufficient. When the concentration of the inorganic binder exceeds 50 wt %, the printability may diminish.

The filler enhances the conductivity of the carbon-based material that is weakly adhered to a substrate and may include, but is not limited to Ag, Al, and Pd.

The composition for forming an electron emission source with a viscosity of about 3,000 to 50,000 cps, preferably about 5,000 to 30,000 cps is achieved by mixing the above-mentioned components.

The method for preparing an electron emission source according to the present invention comprises providing a composition for forming an electron emission source, printing the composition for forming an electron emission source, and heat-treating the printed composition for forming an electron emission source.

A composition for forming an electron emission source is provided as mentioned above. The components that constitute the composition for forming an electron emission source and their concentrations are the same as mentioned above.

The composition for forming an electron emission source is then printed onto a substrate. The term "substrate" refers to a material on which an electron emission source will be prepared. The substrate can vary depending on the electron emission device to be formed, and thus can be easily selected by those skilled in the art. For example, the substrate may refer to a cathode when preparing an electron emission device comprising a gate electrode between a cathode and an anode. It may also refer to an insulation layer that insulates a cathode and a gate electrode when preparing an electron emission device in which the gate electrode is provided at the lower part of the cathode.

The printing method varies based on whether or not the composition for forming an electron emission source comprises a photosensitive resin. When the composition for forming an electron emission source does comprise the photosensitive resin, a separate photoresist pattern is unnecessary. Instead, the composition for forming an electron emission source comprising the photosensitive resin is coated on a substrate by printing and the resulting product is exposed to light and developed to form an electron emission source.

If the composition for forming an electron emission source does not comprise the photosensitive resin, a photolithography process employing a separate photoresist film pattern is needed. A photoresist film pattern is first formed on the substrate by employing a photoresist film. Then the composition for forming an electron emission source is printed on the substrate using the photoresist film pattern.

As mentioned above, according to the printed composition for forming an electron emission source, the adhesion of a carbon-based material to a substrate can be enhanced through heat treatment. In addition, the durability, etc. of the electron emission source can be enhanced and the outgas can be minimized by melting and solidifying more than the binder.

The temperature of the heat treatment must be determined by considering the is volatility of a vehicle comprising the composition for forming an electron emission source, and the temperature and time required for sintering. The typical heat treatment temperature can be 400° C. to 500° C., and preferably 450° C. When the heat treatment temperature is less than 400° C., the volatilization of the vehicle, etc. cannot be sufficiently achieved. When the heat treatment temperature exceeds 500° C., the carbon-based material may be damaged. The heat treatment is carried out in an inert gas atmosphere, such as nitrogen and argon, for example, to minimize the deterioration of the carbon-based material.

In addition, the electron emission source may be subjected to an activation step after the heat treatment. As mentioned above, since the electron emission source of the present invention has a very small concentration of the carbon deposits, an activation step vertically orients the carbon-based material. The activation can be performed by placing an adhesion part that has adhesive properties on the surface of a roller driven with a driving source, pressing the adhesion part on the surface of the fired product with a predetermined pressure, and then separating the adhesion part from the heat treatment product.

The electron emission source of the present invention comprises a carbon-based material and carbon deposits. The concentration of the carbon deposits is about 20 wt % to 30 wt %, and preferably about 20 wt % to 25 wt %, based on the weight of the carbon-based material. The electron emission source of the present invention may be preparing using the composition for forming an electron emission source mentioned above.

The electron emission source of the present invention is heat treated in an inert atmosphere to prevent the carbon-based material from deteriorating during the heat treatment. However, since the composition for forming an electron emission source comprising the resin component and the photosensitive resin as mentioned above is used, the electron emission source comprises a small quantity of the carbon deposits, as mentioned above. The carbon deposits of the electron emission source can decrease the amount of the carbon-based materials that are capable of contributing to a field emission by covering the surface of the electron emission source. This interferes with the vertical orientation of the carbon-based material which decreases the effective field emission.

However, since the electron emission source of the present invention contains a small concentration of carbon deposits as mentioned above, a substantial amount of the carbon-based materials may be exposed to the surface of an electron emission source and may contribute to the electron emission. Thus, a high electric current density can be achieved and a long lifespan can be ensured. Such an electron emission source of the present invention has a high electric current density, for example, about 1000 $\mu A/cm^2$ to 1100 $\mu A/cm^2$ at 9V/μm.

Figure 6:
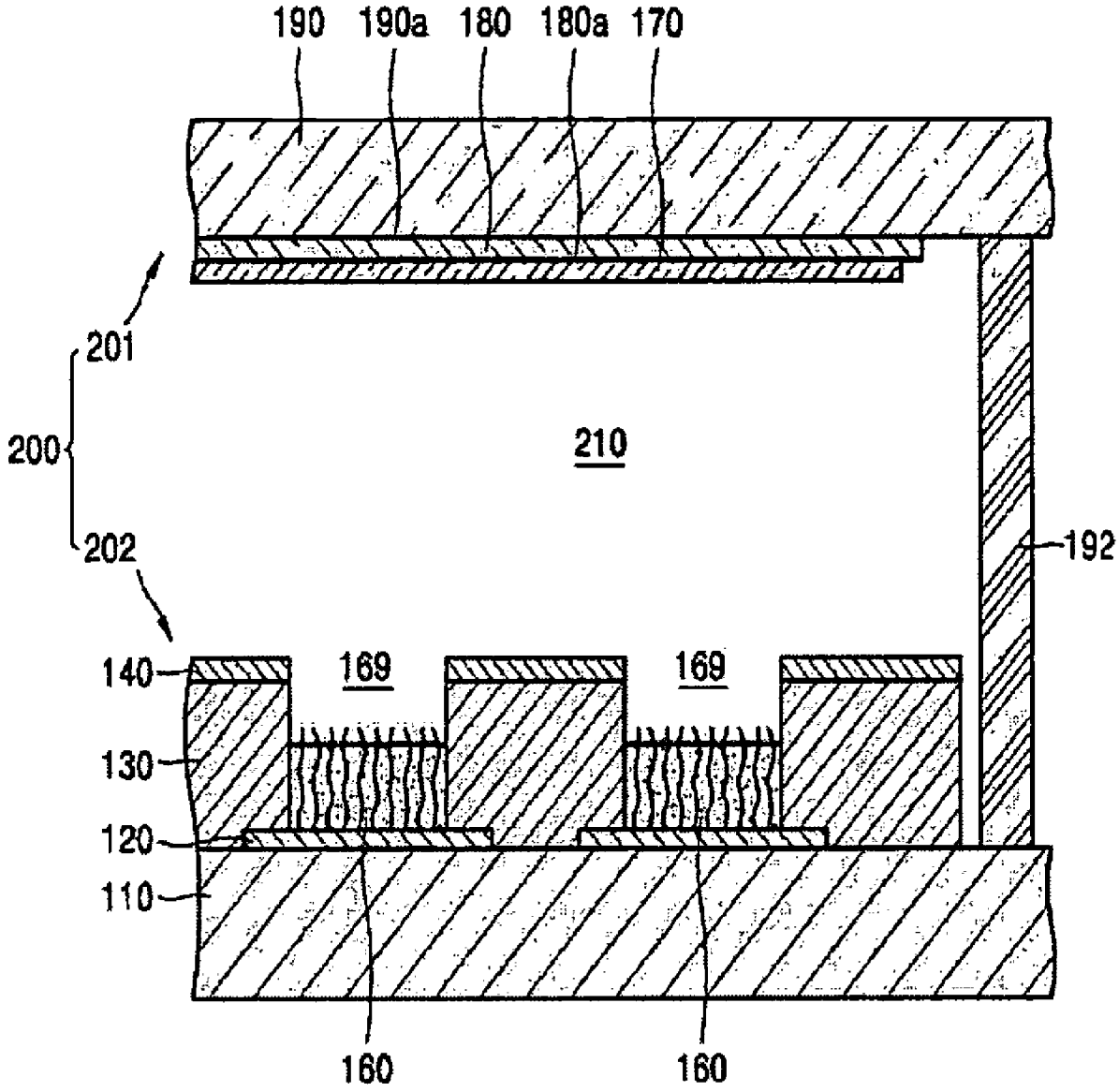
FIG. 6 is a cross-sectional view illustrating an exemplary embodiment of the electron emission device according to the present invention.

FIG. 6 illustrates an embodiment of the electron emission device that is provided with the electron emission source of the present invention. FIG. 6 schematically depicts the electron emission device having a triode structure, but the invention is not limited thereto. For example, the device may also have a diode structure. The electron emission device 200 depicted in FIG. 6 is provided with an upper plate 201 and a lower plate 202. The upper plate is provided with an upper substrate 190, an anode 180 placed in a lower face 190*a* of the upper substrate, and a fluorescent body layer 170 placed in a lower face 180*a* of the anode.

The lower plate 202 is provided with a lower substrate 110 positioned opposite the upper substrate 190 with a spacing such that an inner space is formed. The lower plate 202 further comprises a cathode 120 placed in stripes on the lower substrate 110, a gate electrode 140 placed in stripes to be crossed with the cathode 120, an insulating layer 130 placed between the gate electrode 140 and the cathode 120, a hole 169 of the electron emission source formed in an insulating layer 130 and a part of the gate electrode 140, and an electron emission source 160 placed in the hole 169 of the electron emission source, coupled with the cathode 120, and positioned under the gate electrode 140.

The electron emission source 160 comprises a carbon-based material and carbon deposits. The concentration of the carbon deposits is about 20 wt % to 30 wt % based on the weight of the carbon-based material, as mentioned above. A detailed description of the electron emission source is omitted since it is the same as mentioned above.

The upper plate 201 and the lower plate 202 are maintained in vacuum with a pressure lower than the atmospheric pressure. A spacer 192 is positioned in between the upper plate 201 and the lower plate 202 such that the spacer 192 supports the pressure between the upper plate 201 and the lower plate 202 that is generated by the vacuum. In addition, the spacer 192 defines the light-emitting space 210.

The anode 180 applies a high voltage to accelerate the electrons that are emitted from the electron emission source 160 so that the electrons collide with the fluorescent body layer 170 at a high speed. The fluorescent body of the fluorescent body layer 170 is excited by the electrons, which causes it to emit visible light, etc. while dropping from a high energy level to a low energy level.

The gate electrode 140 allows electrons to be emitted easily from the electron emission source 160. The insulating layer 130 defines the hole 169 of the electron emission source and insulates the electron emission source 160 from the gate electrode 140.

The present invention may also be used in an electron emission device in which the gate electrode is placed in the lower part of the cathode. Further, the present invention can be used in the electron emission device that is provided with a grid/mesh that prevents damage of is the gate electrode and/or cathode by an arc that is generated by discharge phenomenon, and focuses the electrons that are emitted from the electron emission source. Alternatively, the structure of the electron emission device can be also applied to a display apparatus.

The present invention will be described in greater detail with reference to the following examples. The following examples are for illustrative purposes and are not intended to limit the scope of the invention.

EXAMPLE 1

1 g of carbon nanotube powder (SWNT from CNI), 0.25 g of a frit (8000 L, from Shinceramic Co., Korea), 0.91 g of an acrylic resin (from Elvacite Co.), 1.54 g of a polyester diacrylate, and 1.54 g of a benzophenone were added to 4 g of a terpineol. The mixture was stirred to form a composition for forming an electron emission source having a viscosity of 30,000 cps. Then the composition was dried. The composition for forming an electron emission source was printed on the area for forming an electron emission source on a substrate. The substrate was provided with a Cr gate electrode, an insulating film, and an ITO electrode. The substrate and its components were irradiated with an exposure energy of 2000 $mJ/cm^2$ with a parallel exposer using a pattern mask, and then were developed. The weight change of the composition for forming an electron emission source at initial, drying, exposure and developing steps is shown in the Table 1 below.

TABLE 1

| | Initial | After drying | After exposure | After development (just before measuring the quantity of the carbon deposits) |
|---|---|---|---|---|
| Carbon nanotube | 1 g | 1 g | 1 g | 1 g |
| Frit | 0.25 g | 0.25 g | 0.25 g | 0.25 g |
| Terpineol | 7.99 g | 2.44 g | 2.44 g | 1.8 g |
| Acrylic resin | | | | |
| Polyester diacrylate | | | | |
| Benzophenone | | | | |

Figure 7:
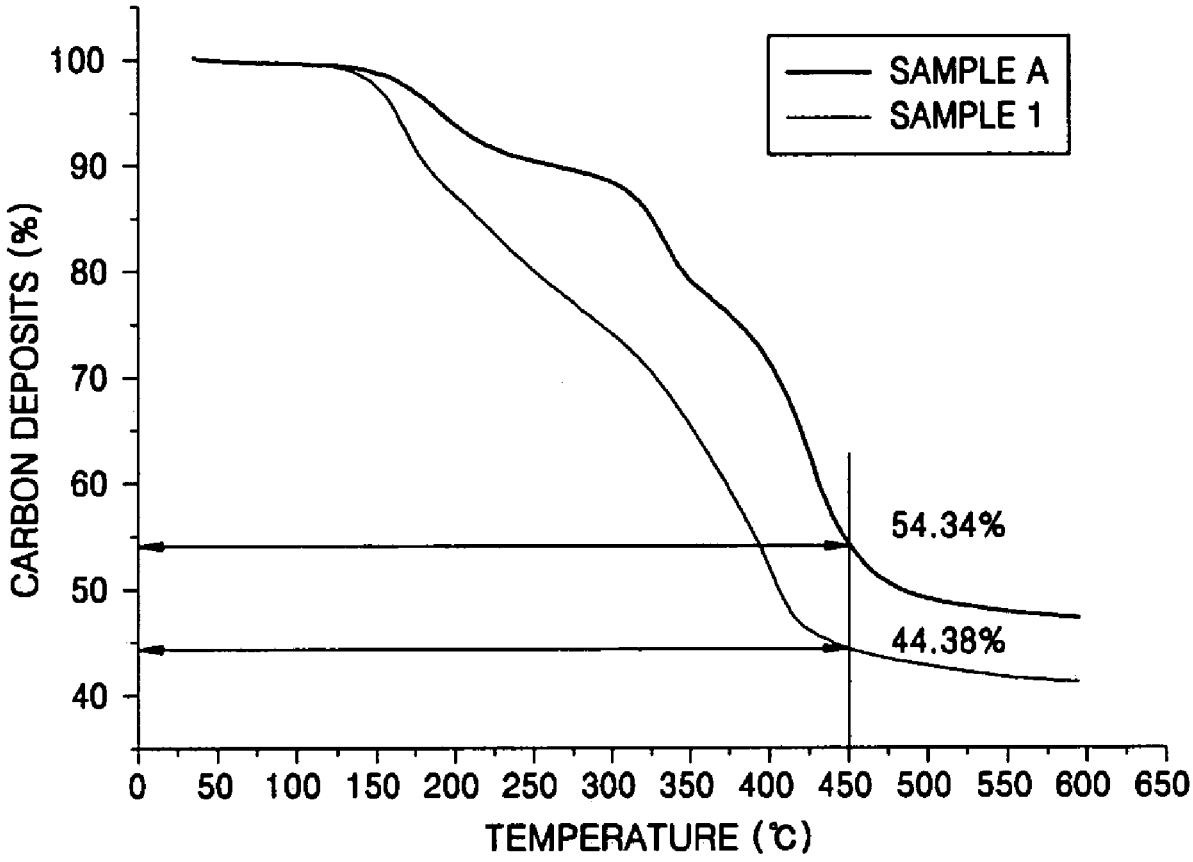
FIG. 7 is a graph illustrating the weight percents of carbon deposits measured after heat treatment in a nitrogen atmosphere of a composition for forming an electron emission source according to an exemplary embodiment of the present invention and of a composition for forming an electron emission source according to the prior art as a function of heat treatment temperature.

An electron emission source was formed by firing the developed product having the component ratios as described in Table 1 at 450° C. This electron emission source is referred to as Sample 1. FIG. 7 is a graph illustrating the concentration of carbon deposits in the composition for forming an electron emission source, measured after heat treatment at various temperatures in a nitrogen atmosphere. As shown in FIG. 7, the concentration of carbon deposits of the Sample 1 heat treated at 450° C. was 44.38%.

COMPARATIVE EXAMPLE 1

A composition for forming an electron emission source was prepared similarly to the method described in Example 1, except that 0.91 g of an ethyl cellulose resin instead of the acrylic resin, and 1.54 g of a pentaerythritol triacrylate instead of the polyester diacrylated were used. Also, the drying, exposure and development of the composition were performed under the same conditions as described in the Example 1. The weight change thereof is shown in Table 2 below.

TABLE 2

| | Initial | After drying | After exposure | After development (just before measuring the quantity of the carbon deposits) |
|---|---|---|---|---|
| Carbon nanotube | 1 g | 1 g | 1 g | 1 g |
| Frit | 0.25 g | 0.25 g | 0.25 g | 0.25 g |
| Terpineol | 7.99 g | 2.35 g | 2.35 g | 2.35 g |
| Ethyl cellulose resin | | | | |
| Pentaerythritol triacrylate | | | | |
| Benzophenone | | | | |

An electron emission source was formed by heat treating the developed product having the component ratios as described in Table 2 at 450° C. This electron emission source is referred to as Sample A. FIG. 7 is a graph illustrating the concentration of carbon deposits in the composition for forming an electron emission source, measured after heat treatment at various temperatures in a nitrogen atmosphere. As shown in FIG. 7, the concentration of carbon deposits of the Sample 1 heat treated at 450° C. was 54.34%.

An electron emission source was formed by heat treating the developed product having the component ratios as described in Table 2 at 450° C. This electron emission source is referred to Sample A. FIG. 7 is a graph illustrating the concentration of the carbon deposits in the composition for forming an electron emission source, measured after heat treatment at various temperatures in a nitrogen atmosphere. As shown in FIG. 7, the concentration of the carbon deposits of the Sample A heat treated at 450° C. was 54.34 wt %.

EVALUATION EXAMPLE 1

Observation of the Surface of the Electron Emission Source

Figure 8A:
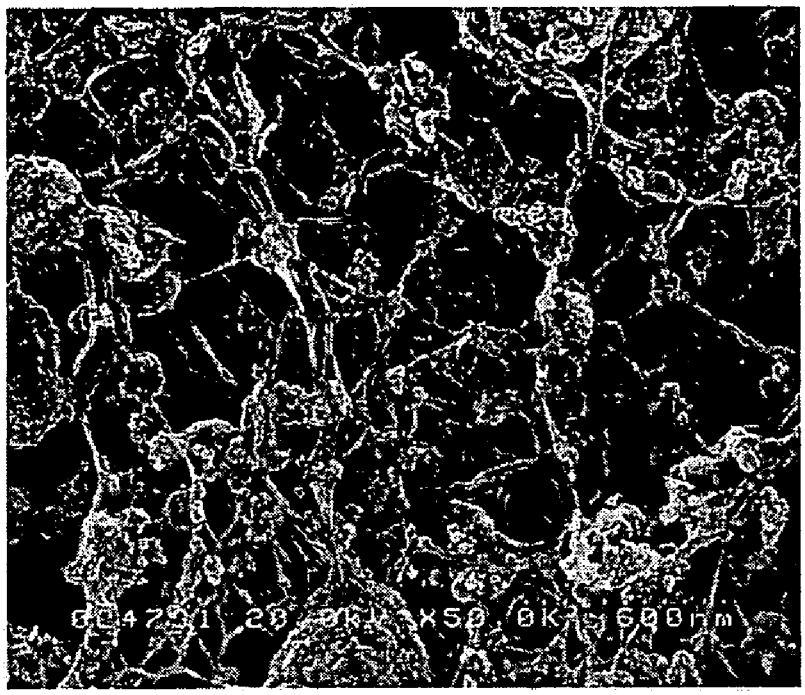
FIG. 8A and FIG. 8B are photographs of the surface of the electron emission source according to the present invention and an electron emission source according to the prior art, respectively.
Figure 8B:
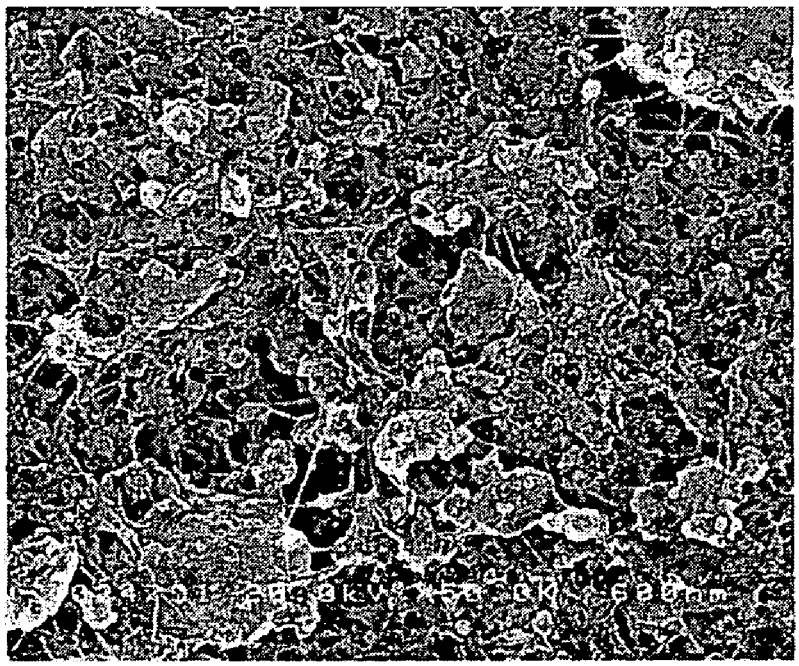

The surfaces of the Sample 1 and Sample A were observed, and then the results are shown in FIG. 8A and FIG. 8B, respectively. It can be seen that the concentration of carbon deposits in the Sample 1 in FIG. 8A is less than that in the Sample A in FIG. 8B.

EVALUATION EXAMPLE 2

Evaluation of the Quantity of the Carbon Deposits of the Electron Emission Source By measuring the concentration of the carbon deposits for 1 g of the carbon nanotube and 0.25 g of the frit used in Example 1 and Comparative Example 1 before and after the heat treatment at 450° C. in the nitrogen atmosphere, the weight change of the carbon nanotube and the frit was calculated. As a result, for the carbon nanotube, 90 wt % of the carbon deposits were obtained, and for the frit, a weight change did not occur even after heat treatment.

Based on the results of measuring the concentration of carbon deposits of the carbon nanotube and the frit, Table 1, and Table 2, and the data of the concentration of carbon deposits in the composition for forming the electron emission source measured in the Example 1 and the Comparative Example 1, the concentration of the carbon deposits for carbon nanotube in the Sample 1 and Sample A was calculated as follows. The calculated results for the Sample 1 are shown in Table 3 below, and those for the Sample A are shown in Table 4 below.

TABLE 3

| | |
|---|---|
| Total weight of the developed product (weight before measuring the carbon deposits) | 1 g + 0.25 g + 1.8 g = 3.05 g (refer to Table 1) |
| Weight of the developed product after heat treatment (weight of the Sample 1) | 3.05 g * 0.4438 = 135 g (refer to the results for measuring the carbon deposits of the Sample 1 in FIG. 7) |
| Weight of the carbon nanotube in Sample 1 | 1 g * 0.9 = 0.9 g (refer to evaluation results of the carbon deposits for the carbon nanotube) |
| Weight of the frit in Sample 1 | 0.25 g (refer to evaluation results of the carbon deposits for the frit) |
| Quantity of the carbon deposits of the Sample 1 | 1.45 g − 0.9 g − 0.25 g = 0.2 g |
| Weight ratio of the carbon deposits to the carbon nanotube in Sample 1 | 0.2 g/0.9 g * 100 = 22.62% |

TABLE 4

| | |
|---|---|
| Total weight of the developed product (weight before measuring the carbon deposits) | 1 g + 0.25 g + 2.35 g = 3.6 g (refer to Table 1) |
| Weight of the developed product after heat treatment (weight of the Sample A) | 3.6 g * 0.5434 = 1.96 g (refer to the results for measuring the carbon deposits of the Sample A in FIG. 7) |
| Weight of the carbon nanotube in Sample A | 1 g * 0.9 = 0.9 g (refer to evaluation results of the carbon deposits for the carbon nanotube) |
| Weight of the frit in Sample A | 0.25 g (refer to evaluation results of the carbon deposits for the frit) |
| Quantity of the carbon deposits of the Sample A | 1.96 g − 0.9 g − 0.25 g = 0.81 g |
| Weight ratio of the carbon deposits to the carbon nanotube in Sample A | 0.81 g/0.9 g * 100 = 89% |

Table 3 and Table 4 indicate that the concentration of the carbon deposits for Sample 1 was 22.62 wt %, and that for Sample A was 89 wt %, based on the weight of the carbon nanotube. From the results, it can be found that Sample 1, i.e., the electron emission source according to the present invention contains a small concentration of the carbon deposits.

EVALUATION EXAMPLE 3

Evaluation of Electric Current Density

Figure 9:
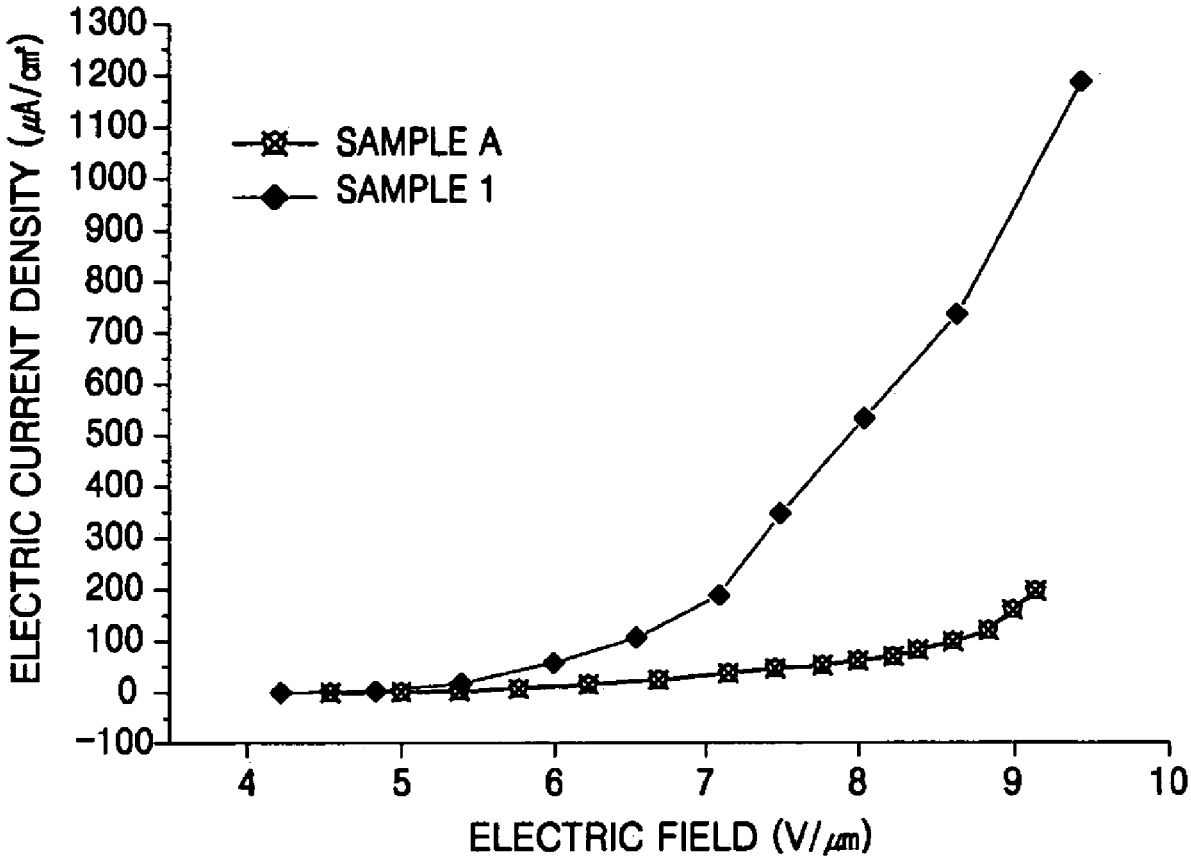
FIG. 9 is a graph illustrating the electric current density according to the electric field for an exemplary embodiment of the electron emission source according to the present invention and an electron emission source according to the prior art.

The electric current density for Sample 1 and Sample A were measured using a pulse power source and an ammeter, and indicated according to the electric field change. The results are shown in FIG. 9. Referring to FIG. 9, the electric current density of Sample 1 having a small concentration of the carbon deposits is higher than that of Sample A at the same electric field. For example, it can be found that Sample 1 has about 1050 $\mu A/cm^2$ of the electric current density at 9V/μm. By contrast, Sample A has about 100 $\mu A/cm^2$ of the electric current density at 9V/μm. From the results, it can be found that the electron emission source according to the present invention has a high electric current density.

EVALUATION EXAMPLE 4

Evaluation of Lifespan

Figure 10:
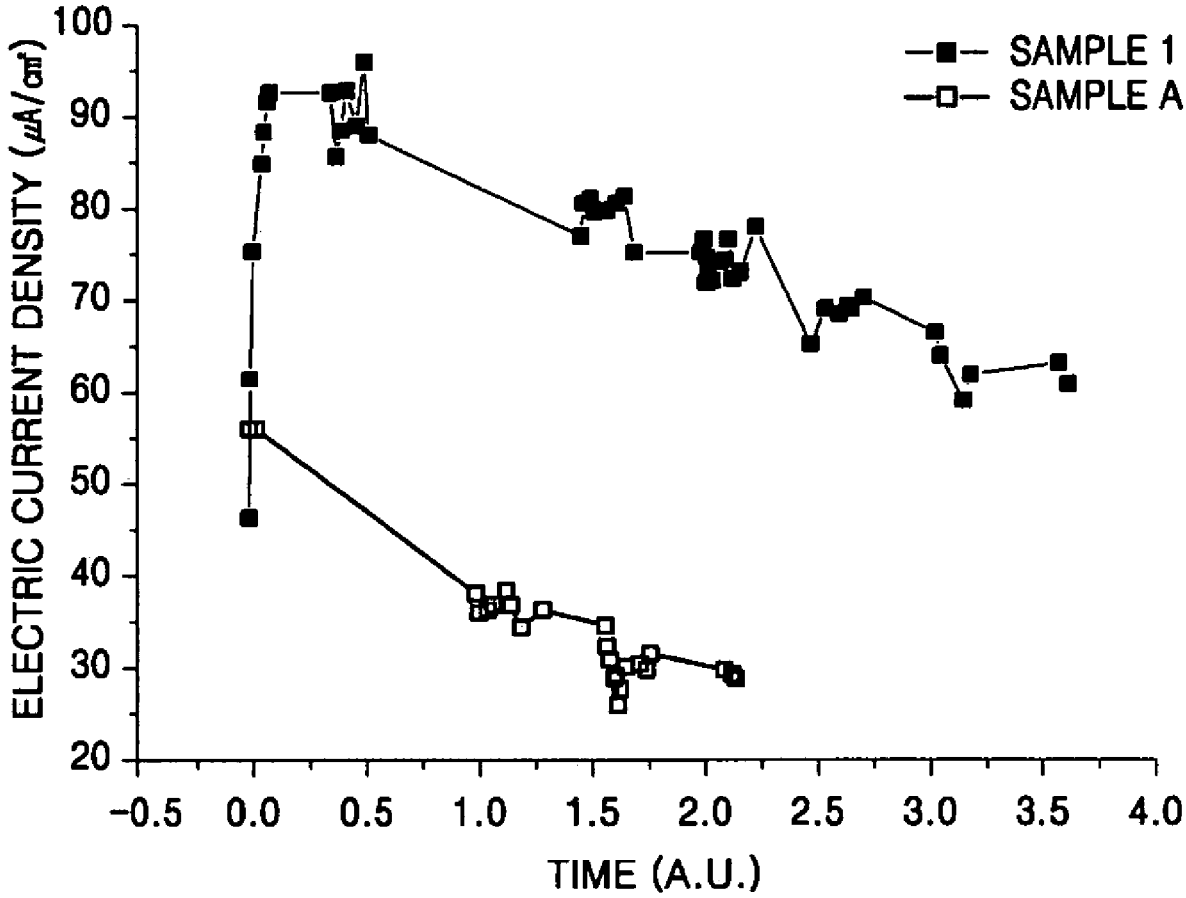
FIG. 10 is a graph illustrating the electric current density according to time for an exemplary embodiment of the electron emission source according to the present invention and an electron emission source according to the prior art.

The electric current density for Sample 1 and Sample A were measured using a pulse power source and an ammeter, and indicated according to the time change. The results are shown in FIG. 10. Referring to FIG. 10, it is indicated that the electric current density of Sample 1 having a small concentration of the carbon deposits is constant even though time lapses. By contrast, the electric current density of Sample A is drastically decreased according to time. The results indicate that the electron emission source according to the present invention has a long lifespan.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A composition for forming an electron emission source, comprising:

a carbon-based material; and a vehicle comprising a resin component and a solvent component;

a photosensitive resin; and a photo-initiator, wherein a quantity of carbon deposit in the resin component is less than 0.5 wt % when heat treatment of the resin component is performed at 450° C. and under nitrogen atmosphere.

2. The composition for forming an electron emission source of claim 1, wherein the resin component is an acrylic resin.

3. The composition for forming an electron emission source of claim 2, wherein the acrylic resin is selected from the group consisting of methylacrylate, ethylacrylate, propylacrylate, n-butylacrylate, isobutylacrylate, t-butylacrylate, 2-ethylhexylacrylate, laurylacrylate, methylmethacrylate, ethylmethacrylate, propylmethacrylate, n-butylmethacrylate, t-butylmethacrylate, 2-ethyihexylmethacrylate, laurylmethacrylate, cyclohexylacrylate, cyclohexylmethacrylate and cellosolvemethacrylate.

4. The composition for forming an electron emission source of claim 1, wherein the solvent component is at least one selected from the group consisting of a terpineol, a butyl carbitol, a butyl carbitol acetate, a toluene and a texanol.

5. The composition for forming an electron emission source of claim 4, wherein the photo-initiator is a benzophenone.

6. The composition for forming an electron emission source of claim 1, wherein a quantity of carbon deposit in an exposure product of the photosensitive resin and the photo-initiator is less than 7wt % when exposure of the photosensitive resin and the photo-initiator is performed at 450° C. and under nitrogen atmosphere.

7. The composition for forming an electron emission source of claim 1, wherein the photosensitive resin is selected from the group consisting of acrylate-based resins.

* * * * *